US009809966B2

(12) United States Patent
Jones et al.

(10) Patent No.: US 9,809,966 B2
(45) Date of Patent: Nov. 7, 2017

(54) HANDHELD BIDET

(71) Applicant: Danco, Inc., Irving, TX (US)

(72) Inventors: Chad H. Jones, Frisco, TX (US); Justin D. Pendleton, The Colony, TX (US); Francis L Fave, Austin, TX (US); David C. Singer, Austin, TX (US)

(73) Assignee: DANCO, INC., Irving, TX (US)

( * ) Notice: Subject to any disclaimer, the term of this patent is extended or adjusted under 35 U.S.C. 154(b) by 393 days.

(21) Appl. No.: 13/832,779

(22) Filed: Mar. 15, 2013

(65) Prior Publication Data

US 2014/0259352 A1 Sep. 18, 2014

(51) Int. Cl.
*A47K 3/022* (2006.01)
*E03D 9/08* (2006.01)

(52) U.S. Cl.
CPC ..... *E03D 9/085* (2013.01)

(58) Field of Classification Search
USPC ..... 4/476, 460; 604/118–121, 181, 187
See application file for complete search history.

(56) References Cited

U.S. PATENT DOCUMENTS 4,510,630 A 4/1985 Osgood
4,890,340 A 1/1990 Lovitt
5,023,961 A * 6/1991 Alonso ..... E03D 9/085 248/231.71
5,097,540 A * 3/1992 Lovitt ..... 4/443
5,809,585 A 9/1998 Farshad
5,864,895 A * 2/1999 Ota et al. ..... 4/443
6,163,898 A 12/2000 Misch
6,357,057 B1 * 3/2002 Krist ..... 4/420.4
6,473,913 B1 * 11/2002 Bell, Sr. ..... 4/448
6,941,590 B2 * 9/2005 Lim ..... E03D 9/085 4/420.4
6,968,580 B1 * 11/2005 Chang Chien ..... 4/420.4
6,978,492 B1 * 12/2005 Francisco et al. ..... 4/420.4
7,543,339 B1 6/2009 Harris
8,117,682 B1 * 2/2012 Bowden ..... E03D 9/085 4/223
8,904,575 B1 * 12/2014 Lindheimer ..... 4/447
2011/0087172 A1 * 4/2011 Gunderson ..... A61M 31/00 604/181

OTHER PUBLICATIONS www.gobidet.com website, printouts from homepage and exemplary product pages submitted herewith.

* cited by examiner

*Primary Examiner* — Lauren Crane
(74) *Attorney, Agent, or Firm* — Ross Barnes LLP; Robin L. Barnes; Monty L. Ross

(57) ABSTRACT

An ergonomically designed hygienic sprayer or bidet apparatus for use with pre-existing fixtures. The sprayer includes an angled portion with a sprayer head disposed on an underside of the angled portion, resulting in a flow of water from the sprayer head that is substantially between 30° and 60° relative to a longitudinal axis of a body portion of the sprayer. The sprayer also includes an actuator located on the same side of the sprayer as the sprayer head and slip-resistance surfaces. An optional mounting base for securely holding a hygienic sprayer in a manner that may disguise its presence or be more aesthetically pleasing. The mounting base is substantially the same size as the hygienic sprayer. The mounting base may be mounted or secured to multiple types of surfaces near the fixture with which the hygienic sprayer is used.

14 Claims, 7 Drawing Sheets

HANDHELD BIDET

BACKGROUND OF THE INVENTION

1. Field of the Invention

This invention relates to a handheld hygienic sprayer or bidet apparatus that may be installed on standard, pre-existing toilet or other water supply lines to aid in spraying water in an ergonomic manner for cleaning and hygiene purposes and that may optionally include a mounting base for securely holding the sprayer in a manner that may disguise its presence or be more aesthetically pleasing.

2. Description of Related Art

The use of a bidet is standard in many parts of the world, including Europe and Asia. A stand-alone bidet is a frequently installed fixture in these parts of the world. In the United States and other western countries, it is less common to have a bidet installed in residential bathrooms or hotel bathrooms. For improved hygiene, to aid with cleanliness for persons with disabilities or limited mobility, or for cultural reasons, it is often desirable to add a bidet to an existing bathroom facility. Installation of a permanent bidet fixture in an existing bathroom is expensive, requiring the addition of plumbing and sufficient floor space to accommodate the fixture, which may require relocation of walls and other fixtures. To avoid this expense, there are many known bidet systems that may be added to a standard toilet. These typically involve connecting a hose having a handheld sprayer to the water line that supplies water to the toilet. The sprayer may then be used when needed much like a traditional bidet.

Many prior art handheld bidet systems include sprayers that are adapted from kitchen sink sprayers or shower head sprayers. These sprayer designs are not well suited for use in a bidet application for several reasons. Many of these sprayers have a trigger to actuate the flow of water that is located on the side of the sprayer opposite the side where the water is discharged. When being used while seated on a toilet, it may be difficult to depress the trigger while holding the sprayer at the proper angle to direct water to the areas to be cleaned, particularly for persons with disabilities or limited mobility. Additionally, the water is sprayed at an angle that is substantially perpendicular to the longitudinal axis of the sprayer. This angle is not the most ergonomic design for a sprayer being used as a bidet. The overall ergonomics of these types of sprayers, including a shorter hand surface and surface materials that may be slippery when wet, are not ideal for bidet use.

Many prior art handheld bidet systems lack an adequate docking station to discretely store the sprayer when not in use. It is desirable to be able to store the sprayer when not in use in a manner that minimizes the appearance of the bidet system, as some users may prefer that the existence of the handheld bidet system not be obvious to guests, or that it blends in with the other fixtures in the bathroom for aesthetic reasons. Some systems include a simple hook-type device to hold the sprayer, which does nothing to disguise the fact that it is a bidet sprayer and is not particularly attractive. Other systems include elaborate and substantially sized cabinets or special toilet tanks to house the bidet system, which are not discrete and may require a substantial amount of space for installation in the bathroom. Examples of these more elaborate systems are disclosed in U.S. Pat. Nos. 7,543,339 and 6,163,898, for example.

SUMMARY OF THE INVENTION

The handheld bidet apparatus disclosed herein may be added to standard and preexisting toilet or other fixtures through the use of an adapter that connects to the water supply line and allows water to be supplied to the toilet (or other fixture) and the handheld sprayer. According to one embodiment of the invention, the hand held sprayer comprises an angled end having a spray head disposed on the underside of the angled portion, rather than the terminal end as is typical with many prior art sprayers. The resulting angle of the water spray from the sprayer head, relative to the longitudinal axis of the sprayer body (the portion generally held by the user during use), is ergonomically designed to achieve efficient cleaning in an easy to use manner and without requiring the user to hold the sprayer in an awkward position to reach all areas that requiring cleaning. For users with limited mobility or disabilities, this water spray angle is particularly beneficial. The hand held sprayer also preferably comprises a trigger to activate the flow of water from the spray head that is located on the same side of the sprayer as the spray head (the same side as the water flow). The preferred trigger location is also ergonomically designed to facilitate easier spraying, particularly when used as a bidet while the user is seated on a toilet. According to another preferred embodiment, the handheld sprayer can swivel to further aid in ease of use and in reaching all areas that require cleaning with the water spray and includes an elongated handle comprising surface materials that resist slippage, particular when wet.

According to another embodiment, the apparatus has a mounting base that is designed to at least partially conceal the handheld sprayer for aesthetic purposes. The mounting base may be mounted to a wall near the toilet or other water supply line, to the surface of a toilet tank, bath tub, or similar fixture, using conventional mounting devices, such as anchors and screws, or using an adhesive pad or strips. According to another embodiment, the mounting base may be hung from the edge of a toilet tank, bath tub, or similar fixture using a detachable hanger. The mounting base, sprayer, and other parts of the apparatus may be made in various finishes, to match or coordinate with each other and the other fixtures or surfaces in the bathroom.

These and other features, objects and advantages of the present invention will become better understood from a consideration of the following detailed description of the preferred embodiments and appended claims in conjunction with the drawings. Although the discussion of the preferred embodiment will focus on use of the apparatus as a bidet for use with a toilet, it may be understood that the embodiments of the invention may be used with other fixtures, such as a bath tub or shower, and may be used for other cleaning purposes, such as cloth diapers. The apparatus will typically be used with water from any available pressurized water system, such as a municipal water supply, but may also be used with a supply of other fluids, such as water containing a cleaning fluid or soap.

BRIEF DESCRIPTION OF THE DRAWINGS

The apparatus of the invention are further described and explained in relation to the following drawings wherein.

DESCRIPTION OF THE PREFERRED EMBODIMENTS

Figure 1:
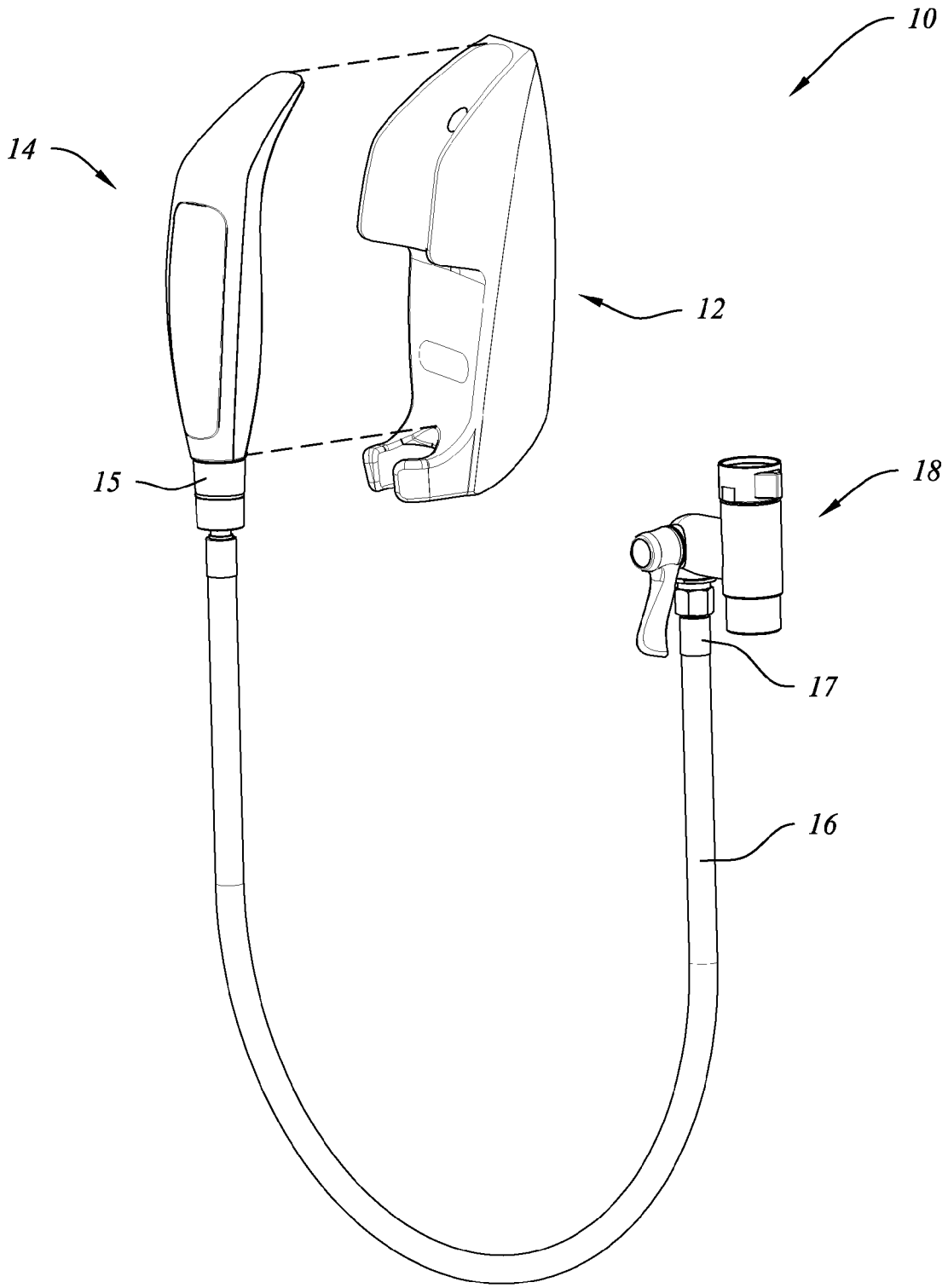
FIG. 1 is a perspective view of one embodiment of an apparatus according to the invention.

Referring to FIG. 1, one preferred embodiment of a handheld bidet apparatus 10 is depicted. Adapter 18 is attached to any pressurized water supply, such as a toilet or tub supply line. Typically, these supply lines have an accessible valve to turn-on or turn-off the supply of water to the fixture, with a pipe, hose, or other flexible tubing running from the valve to the toilet tank or tub faucet. Adapter 18 is preferably designed to integrate with existing supply lines and connections leading to the fixture, to allow water to be supplied to both the handheld sprayer 14 and the fixture itself without requiring any switching between supplying the sprayer or the fixture. Adapter 18 is connected to supply hose 16 by connector 17. Supply hose 16 may be made of any material suitable for water flow, but is preferably a flexible hose or tubing. Connector 17 may be any type of connector, such as a threaded connector that allows supply hose 16 to be securely connected to adapter 18 without leaking during normal use. Supply hose 16 is connected to handheld sprayer 14 by swivel connector 15, which allows handheld sprayer 14 to swivel relative to the supply hose 16. Other connectors may also be used and it is not required that sprayer 14 swivel relative to the supply hose 16. Handheld sprayer 14 mates with and is supported by mounting base 12 when not in use.

Figure 2:
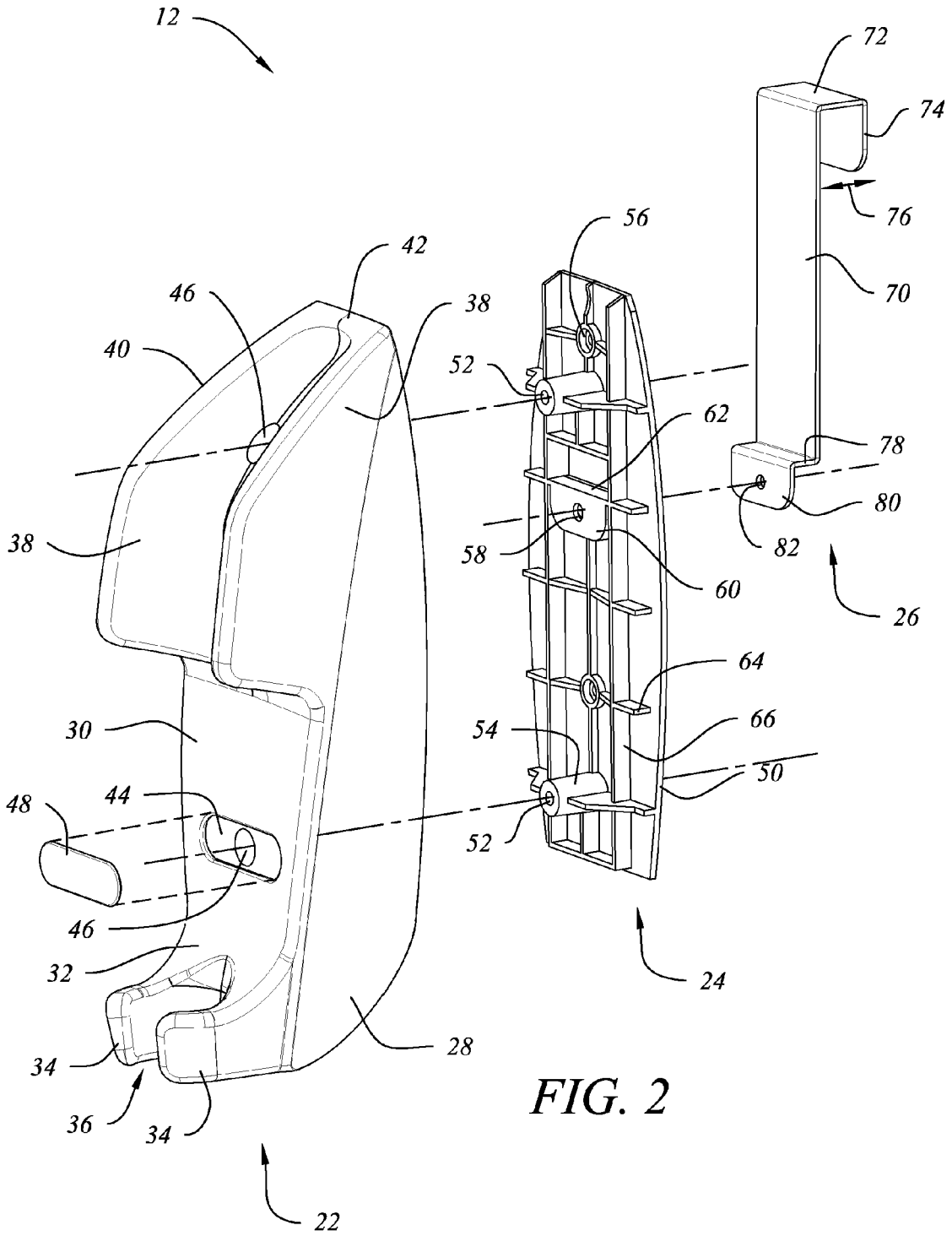
FIG. 2 is a perspective view of a mounting base according to one embodiment of the invention.
Figure 3:
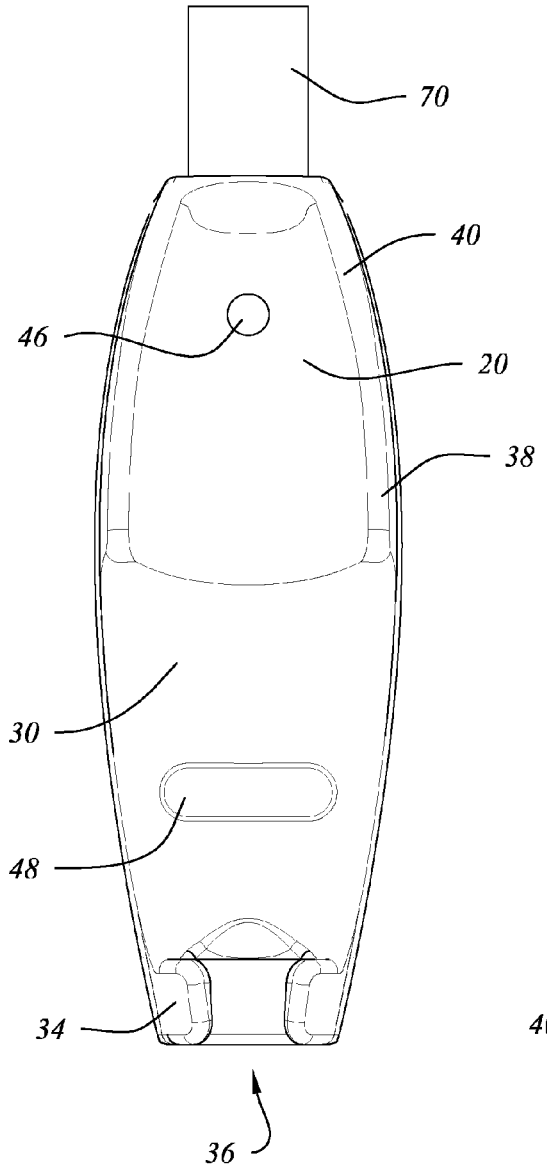
FIG. 3 is a front elevation view of the mounting base of FIG. 2.
Figure 4:
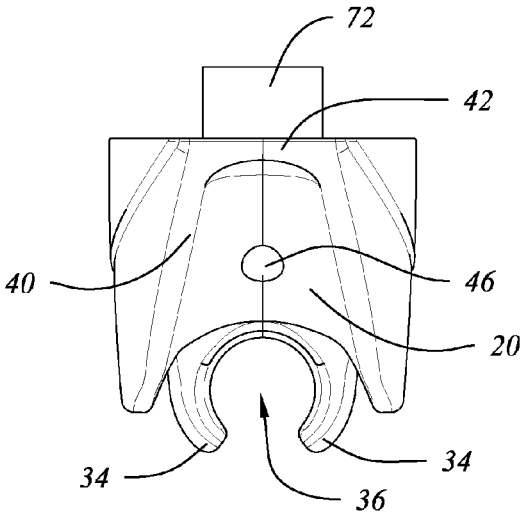
FIG. 4 is a plan view of the mounting base of FIG. 2.
Figure 10:
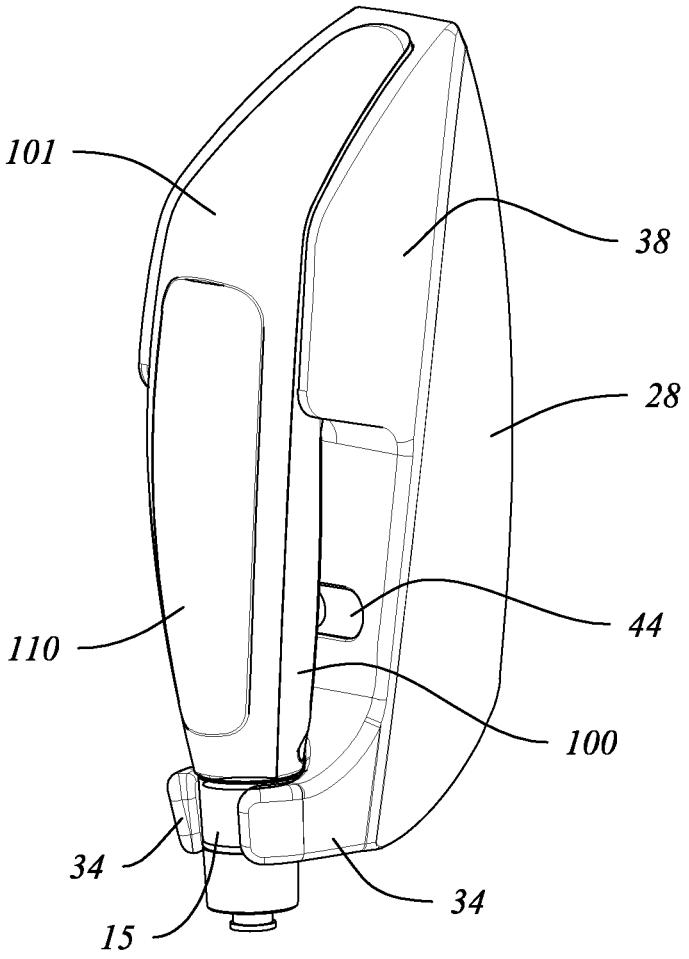
FIG. 10 is a perspective view of the handheld sprayer being held by the mounting base of FIG. 1.

A preferred embodiment of mounting base 12 is depicted in FIGS. 2-4. In this embodiment, mounting base 12 comprises a holder body 22, mounting plate 24, and an optional hanger 26. Holder body 22 is preferably sized to be substantially the same size as the sprayer it will hold. Holder body 22 is preferably used with sprayer 14 according to the invention, but may also be used with other handheld sprayer designs with modifications to the preferred embodiment described herein that will be understood by those of ordinary skill in the art. Holder body 22 preferably comprises upper face 20, sides 28, central face 30, lower face 32, stabilizing arms 34, and concealing panels 38. Stabilizing arms 34 help secure the lower end (nearest swivel connector 15) of handheld sprayer 14 when the sprayer is mounted or docked on mounting base 12 (see FIG. 10). Recess 36 between stabilizing arms 34 allows the lower end of sprayer 14 and supply hose 16 to hang below mounting base 12. Stabilizing arms 34 may also support the lower end of handheld sprayer 14, but preferably the sprayer 14 is substantially supported by upper face 20, which is angled to substantially mate with the angled portion 103 of sprayer 14. Concealing panels 38 also help with stabilizing sprayer 14 when the sprayer is mounted or docked on mounting base 12. Preferably, concealing panels 38 also help to at least partially conceal sprayer 14 when docked and give the unit a more pleasing appearance. Concealing panels 38 preferably each have an upper sloped surface 40 that substantially matches the angle of angled portion 103 on sprayer 14. The forwardly facing edge of concealing panels 38 extends forwardly to substantially the same extent as the front panel 101 of sprayer 14 when docked on holder body 22 or may extend slightly beyond front panel 101 so as to help conceal sprayer 14. Lower face 32 is preferably arcuate or sloped to transition from the substantially flat central face to stabilizing arms 34. At least one mounting aperture 46 is provided in holder body 22 to attach holder body 22 to mounting plate 24. Holder body 22 may be attached to mounting plate 24 by screws, but any other known attachment mechanism, such as toggle bolts, may also be used. Preferably there are two apertures 46, spaced apart longitudinally to provide stability, with the lower aperture 46 located within a recessed area 44 on central face 30 and the upper aperture 46 located on upper angled surface 20. Upper aperture 46 may also be located within a recessed area, if desired. A cover panel 48 is provided to conceal the attachment mechanism on one or more of the apertures 46 located within a recessed area 44.

Mounting plate 24 has receiving apertures 52 that align with mounting apertures 46 for receiving the attachment mechanism to attach holder body 22 to mounting plate 24. When the attachment mechanisms are screws, apertures 52 are each part of a receiving body 54 that has a threaded interior portion and is sized to accommodate the screws. Alternatively, receiving body 54 could be located on the back side of holder body 22. Preferably, the uppermost end of mounting plate 24 does not extend beyond top edge 42 of holder body 22 and the lower most end of mounting plate 24 does not extend beyond the lower edge of stabilizing arms 34, and the sides of mounting plate 24 do not extend beyond the sides 28, so that the mounting plate 24 is completely concealed behind holder body 22 when in use. Mounting plate 24 also comprises a frame 50 having a plurality of horizontal reinforcing ribs 64 and vertical reinforcing ribs 66 to provide structural support to the frame 50 while allowing the overall thickness of frame 50 and total material used in the mounting plate 24 to be reduced. Frame 50 also includes at least one mounting aperture 56. Preferably there are two apertures 56, spaced apart longitudinally to provide stability. If mounting base 12 is to be mounted on a wall, screws and anchors, toggle bolts, and similar devices may be used to attach frame 50 to the wall through apertures 56. Once mounted to the wall, holder body 22 may be attached to mounting plate 24 through apertures 46 and 52. Alternatively, mounting plate 24 may be mounted to the wall, toilet tank, side of a bath tub, or similar surface using an adhesive panel. Preferably the adhesive panel has adhesive on both sides, one side to adhere to the back side of frame 50 and the other to adhere to the mounting surface.

As another alternative, mounting plate 24 may be hung from any suitable lip, such as the lip on a toilet tank, using hanger 26. Hanger 26 preferably comprises a vertical body 70, upper surface 72, hanging lip 74, mounting lip 78, and mounting face 80. The distance 76 between the back side of vertical body 70 and the front side of hanging lip 74 is designed to at least accommodate the thickness of the typical lip, or upper edge, on a toilet tank. A double sided adhesive strip may also be placed on the back side of vertical body 70 to adhere hanger 26 to the side of the toilet tank or similar fixture from which it is hung, which prevents rattling that may occur if the distance 76 is substantially larger than the lip from which it is hung. Since hanging lip 74 will carry the weight, it is not necessary that any adhesive strip placed on the back side of vertical body 70 be substantial enough to support mounting plate 24, holder body 22, and sprayer 14. Mounting face 80 preferably includes a mounting aperture 82 that aligns with optional hanger mounting aperture 58 on frame 50. A screw is the preferred mechanism for attaching hanger 26 to mounting plate 24, but other attachment mechanisms may be used. When used with a screw, aperture 58 is preferably part of a receiving body 60 that has a threaded interior portion and is sized to accommodate the screw. Alternatively, receiving body 60 could be located on mounting face 80. Frame 50 also preferably comprises a lip 62 that mates with mounting lip 78. If hanger 26 is used, it is preferably attached to mounting plate 26 prior to attaching holder body 22 to mounting plate 26. Most preferably, handheld bidet apparatus 10 comprises a kit containing adhesive pads and hanger 26 and may also include screws and wall anchors to provide multiple options for securing mounting base 12 to a variety of surfaces near the fixture with which apparatus 10 is to be used. Mounting base 12 may be installed before or after adapter 18 is connected to the water supply.

Figure 5:
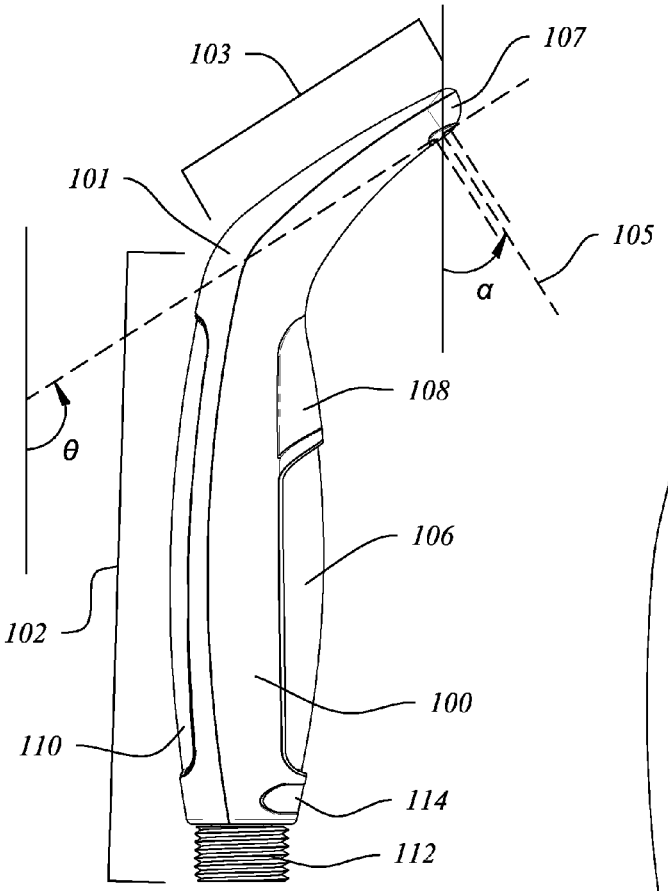
FIG. 5 is a side elevation view of a handheld sprayer according to one embodiment of the invention.
Figure 6:
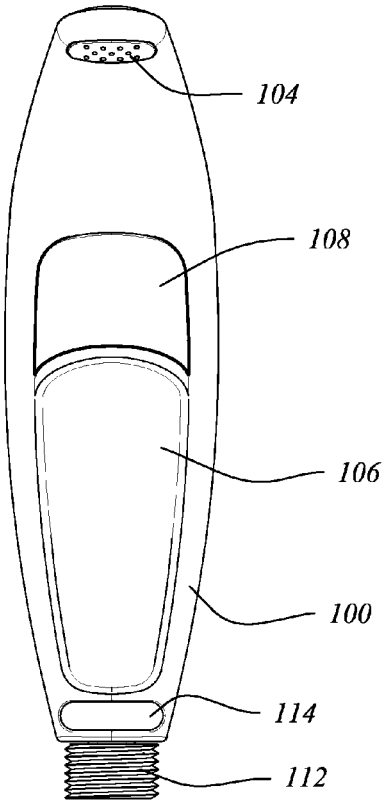
FIG. 6 is a front elevation view of the handheld sprayer of FIG. 5.

A preferred embodiment of sprayer 14 is depicted in FIGS. 5-7 and FIG. 10 depicts the sprayer 14 as docked on mounting base 12 when not in use. Sprayer 14 comprises a longitudinal body 102, angled portion 103, rear panel 100, front panel 101, sprayer head 104, rear grip surface 106, a push-button type trigger 108, front grip surface 110, and a sprayer valve 116. Longitudinal body 102 is the longer portion of sprayer 14 that is typically held by the user during use. Although other sizes may be used, longitudinal body 102 is preferably slightly longer than the average adult palm so that the sprayer may be comfortably held by the user. Additionally, longitudinal body 102 is preferably slightly bowed in the mid-section (as shown in FIG. 5) and slightly wider at the end where longitudinal body 102 transitions to angled portion 103 (as shown in FIG. 6). Sprayer head 104 is preferably located near the upper end or terminal end 107 of angled portion 103, on the face of rear panel 100. Measured from a point near sprayer head 104, the angle θ of angled portion 103 relative to the longitudinal axis of longitudinal body 102 is preferably obtuse. In the preferred embodiment depicted in FIGS. 5-7, angle θ is approximately 135°. Other angles, in the range of 120° to 150°, and most preferably from 130° to 140° may also be used.

Sprayer head 104 preferably comprises a plurality of openings to allow water spray 105 to flow in small streams, although a single opening may also be used. Although there is some variation in the angle of water spray 105 when multiple openings are used in sprayer head 104, water spray 105 exits sprayer head 104 in a direction substantially perpendicular to sprayer head 104. With sprayer head in this preferred location on the underside of angled portion 103 (rather than at the terminal end 107, as is common in prior art sprayers), the resulting angle α of water spray 105 relative to the longitudinal axis of longitudinal body 102 is preferably acute. In the preferred embodiment depicted in FIGS. 5-7, the angle α is approximately 45°. Other angles, in the range of 30° to 60°, and most preferably from 40° to 50° may also be used. Sprayer head 104 may be located elsewhere on sprayer 14, but it is preferred that the angle of water spray 105 be within these ranges for the most efficient use of sprayer 14. These angle ranges provide the best ergonomic design for sprayer 14, allowing water spray 105 to easily reach all desired areas for cleaning without requiring the user to contort sprayer 14 and/or the user's hand in uncomfortable or unusual positions. Sprayer head 104 may also be pivotable relative to angled portion 103, allowing the user to alter the angle α of water spray 105 relative to the longitudinal axis of longitudinal body 102 through a range of angles, preferably between 30° to 60°.

Trigger or actuator 108, for activating sprayer valve 116 and turning on or off the flow of water spray 105, is located on the rear side (the same side as water spray 105) of sprayer 14. This location for trigger 108 also facilitates ease of use. Preferably, trigger 108 is located just below the transition from body 102 to angled portion 103. This location allows the user's thumb or finger to hook on the angled portion 103 to provide support for the sprayer 14 when in use. In combination with grip surfaces 106 and 110, having the trigger in this preferred location further aids in the user being able to maintain control over the sprayer 14 when in use. Although a simple push-button type trigger is preferred, other types of actuators may be used, such as a pull-type trigger or a slider.

Figure 7:
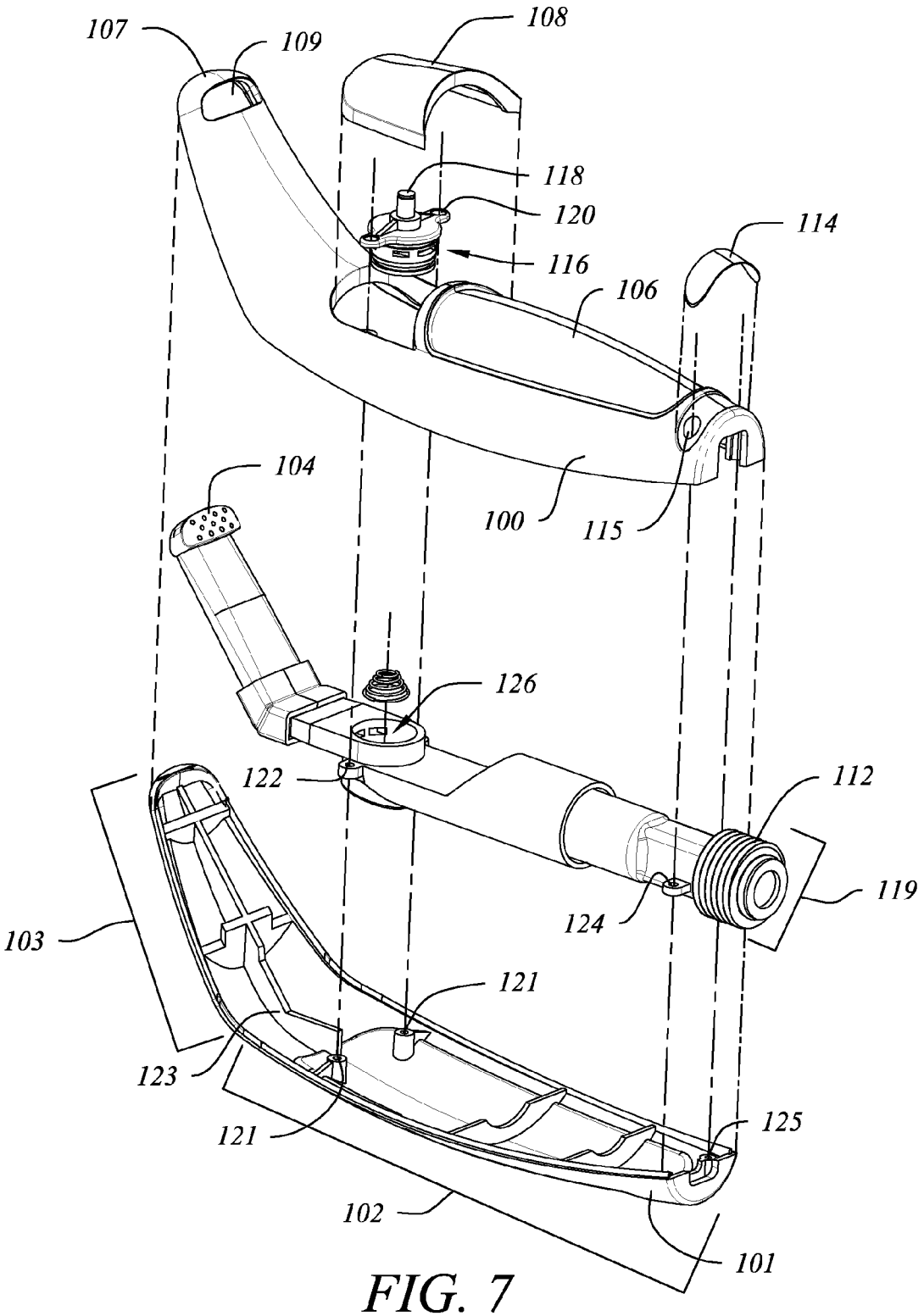
FIG. 7 is a perspective, partially exploded view of the handheld sprayer of FIG. 5.

Referring to FIG. 7, a preferred embodiment of sprayer 14 is depicted, showing how rear panel 100 and front panel 101 cover the internal mechanisms 119 of the sprayer. The rear and front panels 100 and 101 each have angled upper portions to substantially match the angle of angled portion 103. The internal mechanisms 119 contained by panels 100 and 101 are well known plumbing parts pieced together to form a fluid flow channel through the sprayer. Sprayer valve 116 controls the flow of water from supply hose 16 to sprayer head 104. Any type of valve may be used for valve 116 that will permit water flow to sprayer head 104 to be turned-on and shut-off as desired, but preferably valve 116 is a piston-style valve that is activated by pressing trigger 108, which depresses button 118. Valve 116 is seated within recessed area 126. At least one, and preferably two, valve mounting apertures 120 are provided to secure valve 116 within sprayer 14. Mounting apertures 120 align with corresponding receiving apertures 122 and receiving body 121 on the interior of front panel 101. Any attachment mechanism may be used, but valve 116 is preferably secured in place by screws, with receiving body 121 being sized to accommodate the screws and having interior threads. Front panel 101 and rear panel 100 are connected together via any suitable attachment mechanism, but preferably screws are inserted through aligned apertures 115, 124, and 125. Most preferably there are at least two of these apertures spaced apart to provide stability. Apertures 125 are preferably receiving bodies sized to accommodate screws and having a threaded interior portion. A cover panel 114 may be used to conceal the attachment mechanism on the rear panel 100. Front and rear panels 101 and 100 also preferably have a snap fit or similar mechanism around their perimeters or a portion of their perimeters to help hold the two panels together. The interior surface of rear panel 100 and front panel 101 also preferably have reinforcing ribs 123 to provide structural support to the panels while allowing the overall thickness of panels and total material used in the panels to be reduced. Connector 112 connects to swivel connector 15 to permit the flow of water from supply hose 16 to sprayer 14. An aperture 109 on the face of real panel 100 accommodates sprayer head 104.

Figure 9:
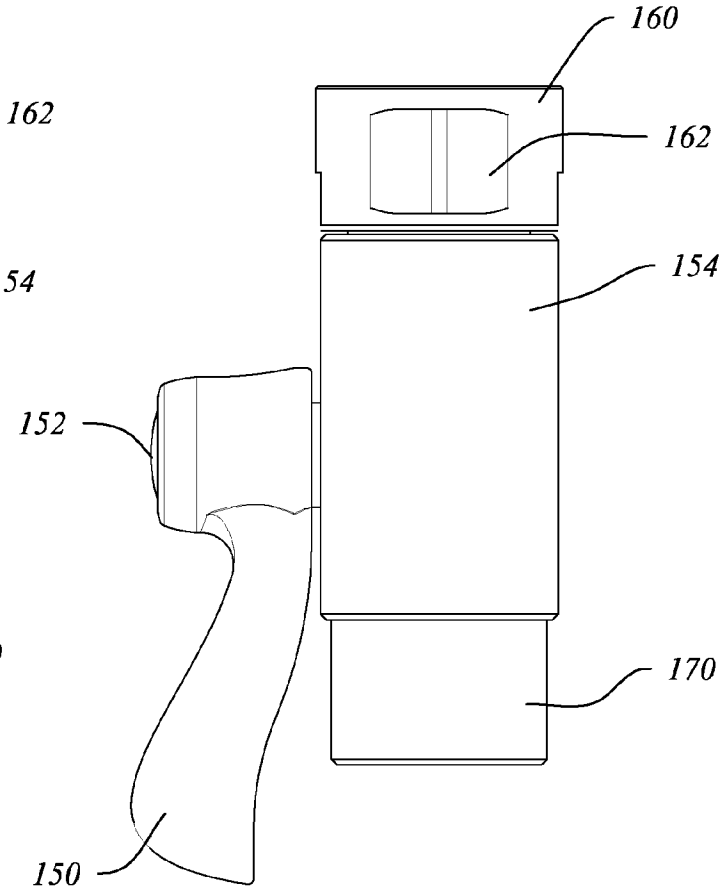
FIG. 9 is a side elevation view of the adapter of FIG. 8.
Figure 8:
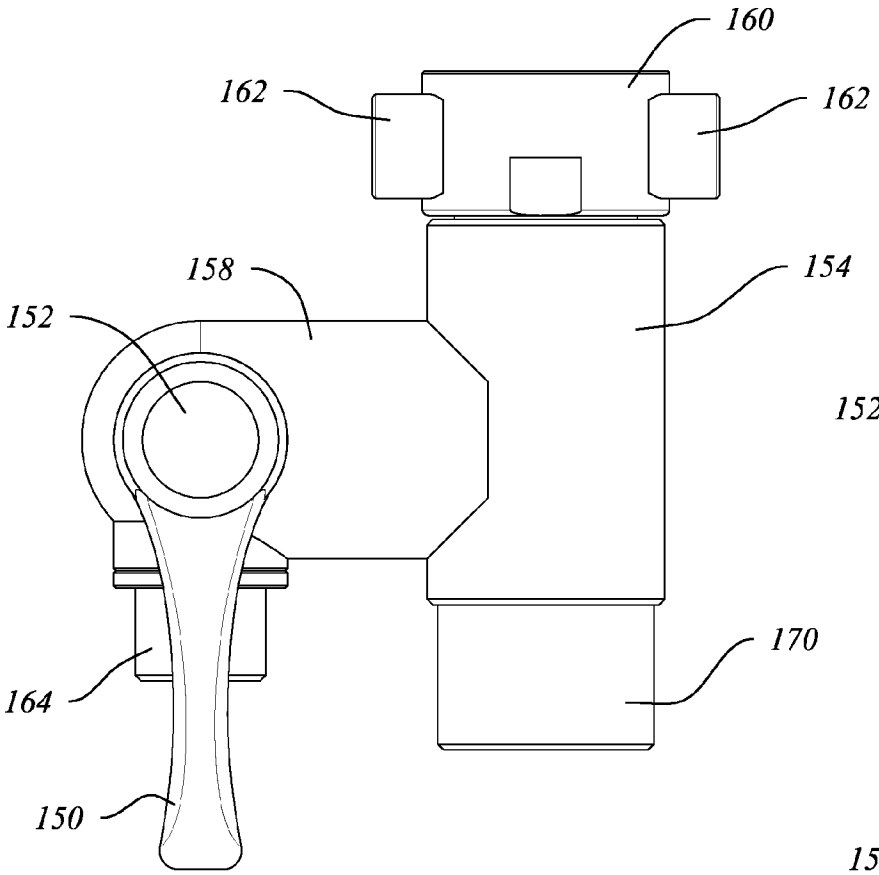
FIG. 8 is a front elevation view of an adapter according to an embodiment of the invention.

A preferred embodiment of adapter 18 is depicted in FIGS. 8 and 9. Adapter 18 is preferably a t-connector that allows water to supply both handheld sprayer 14 and the fixture, such as a toilet, with which the apparatus 10 is being used. Adapter 18 comprises connector body 154, connector 160, connector 170, arm 158, handle 150, and hose connector 164. For installation on a toilet, for example, the water supply to the toilet is shut-off and the toilet is flushed to drain water standing in the supply hose leading to the toilet tank. The supply hose is then disconnected from the tank and connector 160 is attached to the tank in its place. Connector 160 has wings 162 allowing for easy attachment to the threaded connection on most toilet tanks as the wings 162 are rotated to tighten connector 160 to the connection on the tank without requiring rotation of the entire adapter 18. The end of the supply line that was previously disconnected from the toilet tank is then connected to connector 170. Preferably, connector 170 is threaded to mate with the supply line, although the threads are not depicted in FIGS. 8 and 9. Inside arm 158 and connected to handle 150 is a typical valve, such as a ball valve (not depicted), that allows the flow of water through arm 158 and hose connector 164 to be turned-on or shut-off. Cover plate 152 conceals the attachment mechanism, such as a screw, between handle 150 and the interior valve. Hose connector 164 is then attached to one end of hose 16 with the other end of hose 16 being attached to swivel connector 15. Once these connections are made, the water supply is turned back on and handle 150 is rotated to turn-on the interior valve in adapter 18 allowing water to flow to sprayer 14. In typical use, it is not necessary to rotate handle 150 to shut-off the supply of water to sprayer 14 when not in use and the handle 150 may be left in the on position. If it is expected that the sprayer 14 will not be used for an extended period of time, then the handle may be moved to the off position. Those of ordinary skill in the art will understand the modifications that may be necessary, such as modifications to connectors 160 and 170, for installations with other type of fixtures, such as bath tubs.

The handheld hygienic sprayer or bidet apparatus according to the invention most preferably comprises a kit having an adapter for connecting to the water or other fluid supply (while also allowing supply of water or other fluid to the fixture), supply hose, sprayer, and mounting base, along with at least two mechanisms for mounting the mounting base to or from a surface near the fixture. Such a kit would preferably be available in different finishes to match or coordinate with the décor and fixtures in the bathroom where it will be used. The various parts may also be available separately.

References to front (or forward) and rear (or back) herein generally refer to the direction when the sprayer 14 is docked on mounting base 12 and mounting base 12 is secured to a substrate, such as a wall or toilet tank. The wall or toilet tank would be in the rear direction, with the mounting base 12 and sprayer 14 being progressively forward thereof. The use of certain plumbing parts, such as washers and valves, are well known to those of ordinary skill in the art may be used in connection with the present invention. Those of ordinary skill in the art will also appreciate upon reading this specification and the description of preferred embodiments herein that modifications and alterations to the apparatus and methods may be made within the scope of the invention and it is intended that the scope of the invention disclosed herein be limited only by the broadest interpretation of the appended claims to which the inventor is legally entitled.

We claim:

1. A handheld hygienic sprayer comprising:

a body comprising a longitudinal portion having a longitudinal axis and an angled portion disposed at an angle between 120° and 150° relative to the longitudinal axis;

a sprayer head disposed near an end of the angled portion for spraying a fluid at an angle substantially between 30° and 60° relative to the longitudinal axis; and wherein the combined angle of the angled portion and the angle of the fluid spray are configured for ergonomic ease of use of the sprayer as a bidet.

2. The sprayer according to claim 1 further comprising an actuator for activating the flow of the fluid, wherein the actuator is disposed on the same side of the body as the sprayer head; wherein that side of the body is laterally wider in an area near the actuator and laterally narrower in an area near the sprayer head; and wherein the actuator location and body shape are configured for ergonomic ease of use of the sprayer.

3. The sprayer according to claim 1 wherein the sprayer further comprises a swivel connector for connecting to a hose to supply fluid to the sprayer that allows the sprayer to be rotated relative to the hose without being disconnected from the hose.

4. The sprayer according to claim 2 wherein at least part of the surface of the longitudinal portion of the body is made from slip-resistant material.

5. The handheld hygienic sprayer of claim 1 wherein the sprayer head is configured to spray fluid at an angle or range of angles substantially between 30° and 50° relative to the longitudinal axis.

6. The handheld hygienic sprayer of claim 1 wherein the sprayer head is configured to spray fluid at an angle or range of angles substantially between 30° and 45° relative to the longitudinal axis.

7. The handheld hygienic sprayer of claim 1 wherein the angled portion is disposed at an angle between 120° and 140° relative to the longitudinal axis.

8. The handheld hygienic sprayer of claim 2 wherein the sprayer head is configured to spray fluid at an angle or range of angle substantially between 30° and 50° relative to the longitudinal axis.

9. The sprayer according to claim 1 further comprising a mounting base, the mounting base comprising a holder body that is substantially the same size as the sprayer;

wherein the holder body comprises a front face having a lower surface with a longitudinal axis configured to mate with the longitudinal portion of the sprayer body and an upper surface configured to mate with the angled portion of the sprayer body; and wherein the upper surface of the front face is disposed at an angle between 120° and 150° relative to the longitudinal axis of the lower surface.

10. The sprayer according to claim 9 wherein the mounting base further comprises a mounting plate comprising at a first aperture and a second aperture;

wherein the holder body comprises a third aperture;

wherein the first aperture allows the mounting plate to be secured to a substrate using an attachment mechanism; and wherein the second and third apertures align to allow the holder body to be secured to the mounting plate using another attachment mechanism.

11. The sprayer according to claim 9 wherein the mounting base further comprises an adhesive pad for securing the mounting plate to a substrate and a hanger for hanging the mounting plate from a surface having a lip, so that the mounting base may be mounted to multiple types of substrates or surfaces.

12. The sprayer according to claim 9 wherein the holder body further comprises concealing side panels that extend forwardly from the front face, wherein an upper edge of each side panel is substantially parallel to the upper surface.

13. The sprayer according to claim 12 wherein holder body further comprises stabilizing arms extending forwardly from the front face and spaced apart along the front face longitudinally from the concealing side panels.

14. The sprayer according to claim 2 wherein the actuator is disposed on the longitudinal portion of the body in an area adjacent to the angled portion of the body.

* * * * *